US006290530B1

(12) United States Patent
Chang

(10) Patent No.: US 6,290,530 B1
(45) Date of Patent: Sep. 18, 2001

(54) ELECTRICAL CONNECTOR WITH IMPROVED GUIDING MEANS

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/541,739

(22) Filed: Apr. 3, 2000

(30) Foreign Application Priority Data

Mar. 3, 2000 (TW) ..... 89203420

(51) Int. Cl.[7] ..... H01R 13/629

(52) U.S. Cl. ..... 439/378; 439/357; 439/610; 439/76.1

(58) Field of Search ..... 439/610, 378, 439/358, 357, 76.1

(56) References Cited

U.S. PATENT DOCUMENTS

D. 351,136 * 10/1994 Kurata ..... D13/147
5,356,300 * 10/1994 Costello et al. ..... 439/378
5,797,771 * 8/1998 Garside ..... 439/610
5,934,942 * 8/1999 Patel et al. ..... 439/610
5,941,726 * 8/1999 Koegel et al. ..... 439/358
6,074,236 * 6/2000 Wu ..... 439/378
6,083,049 * 7/2000 Kuo et al. ..... 439/610

* cited by examiner

*Primary Examiner*—Gary F. Paumen
(74) *Attorney, Agent, or Firm*—Wei Te Chung

(57) ABSTRACT

An electrical connector has an insulative housing, a plurality of contacts received in the housing, an upper shell, a lower shell, a base, a cover and a pair of latches. The upper shell and the lower shell engage with each other to receive the housing therein. The base comprises a pair of lateral walls defining a cavity therebetween for receiving the housing. A guiding post forwardly projects from a front end of each lateral wall of the base for guiding the connector to connect with the mating connector and defines a slit for receiving a corresponding latch. The lower shell comprises a lower enclosing portion and a pair of side retaining arms upwardly extending from opposite edges of the lower enclosing portion. A front retaining arm laterally extends from a front end of each side retaining arm. The front retaining arms and the side retaining arms shield and strengthen the guiding posts.

1 Claim, 5 Drawing Sheets

ELECTRICAL CONNECTOR WITH IMPROVED GUIDING MEANS

BACKGROUND OF THE INVENTION

The present invention relates to an electrical connector, and more particularly to a mobile phone cable connector with means for strengthening guiding posts thereof.

An electrical connector is often desired to engage with a mating electrical connector, in which guiding means is required to facilitate the mating and to ensure positioning. A conventional electrical connector is illustrated in U.S. Des. Pat. No. 351,136, as shown in FIG. 5. The electrical connector comprises an insulative housing 20 and a plurality of contacts 30 received in a middle portion of the housing 20. A pair of guiding posts 21 respectively forwardly extends from opposite sides and beyond a front face 22 of the housing 20 for guiding an insertion of a mating electrical connector (not shown) into the electrical connector.

The guiding posts 21 are relatively slender and have no shielding, and therefore are of weak strength. The weak nature of the guiding posts causes them to be readily broken if the connector is carelessly connected with the mating connector.

BRIEF SUMMARY OF THE INVENTION

A main object of the present invention is to provide an electrical connector which has guiding means with improved strength.

Another object of the present invention is to provide shells used in a mobile phone connector which can strengthen and shield guiding posts of the connector.

An electrical connector in accordance with the present invention comprises an insulative housing, a plurality of contacts received in the housing, an upper shell, a lower shell, a base, a cover and a pair of latches. The housing comprises a projecting portion forwardly extending from a front thereof for receiving contact portions of the contacts. The base includes a pair of lateral walls defining a cavity therebetween for receiving the housing. A pair of guiding posts is respectively formed projecting forwardly from a front end of the lateral walls. Each guiding post and associated lateral wall longitudinally defines a slit in a middle thereof for receiving a corresponding latch therein. The upper shell comprises an upper wall, two side walls, a rear upper flap and an upper enclosing portion. The lower shell comprises a bottom wall, a lower flap upwardly extending from a rear edge of the bottom wall and a lower enclosing portion. A pair of side retaining arms extends upward from opposite edges of the lower enclosing portion. A front retaining arm inwardly extends from a forward edge of each side retaining arm. The side retaining arms and the front retaining arms shroud the guiding posts for strengthening and shielding the guiding posts.

Other objects, advantages and novel features of the invention will become more apparent from the following detailed description when taken in conjunction with the accompanying drawings.

DETAILED DESCRIPTION OF THE INVENTION

Figure 1:
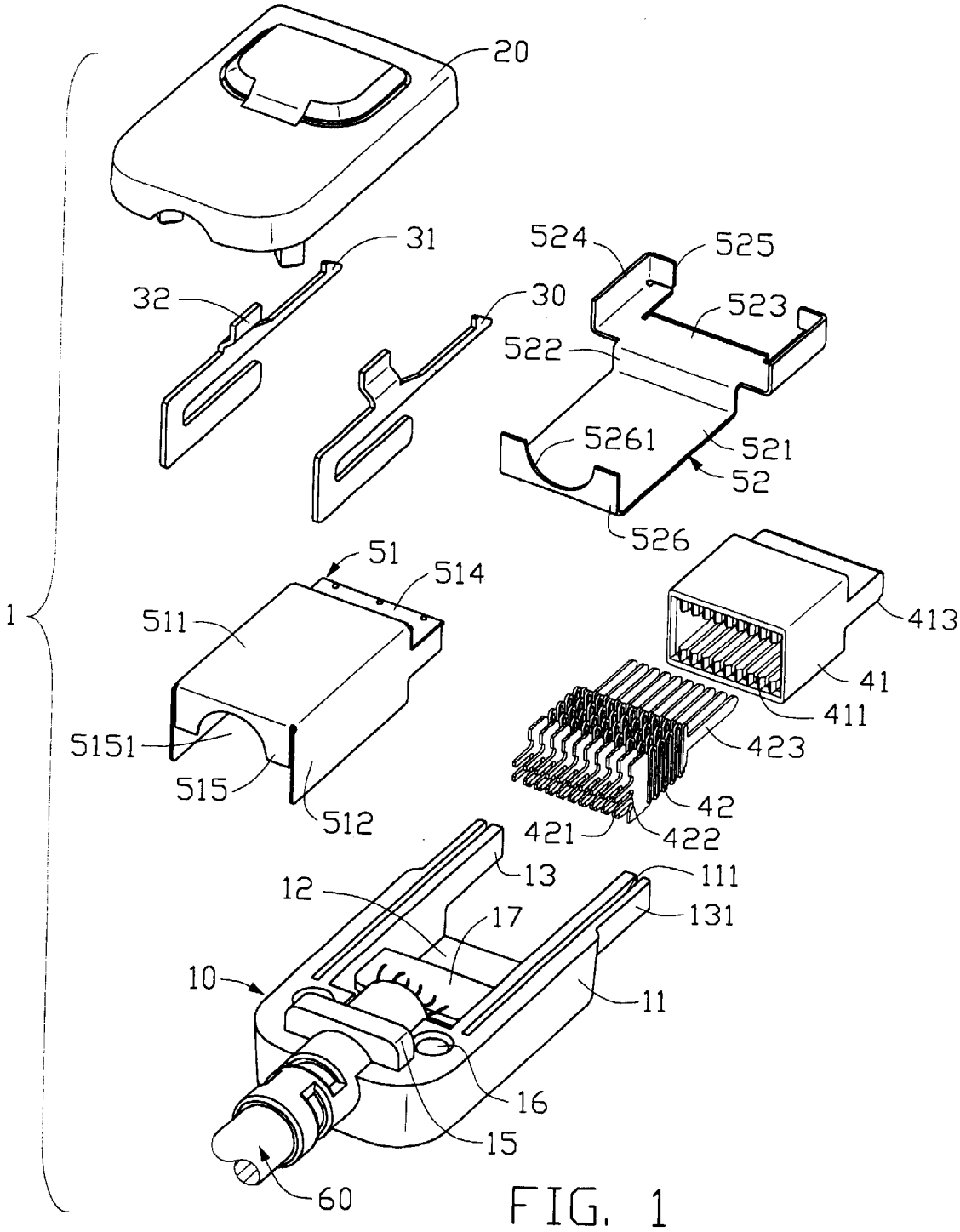
FIG. 1 is an exploded view of an electrical connector in accordance with the present invention, wherein a cable is assembled to a base of the electrical connector.

Referring to FIG. 1, an electrical connector 1 according to the present invention comprises a plurality of contacts 42, an insulative housing 41 for receiving the contacts 42, a base 10 for receiving the housing 41 together with an end portion of a cable 60, a cover 20, an upper shell 51, a lower shell 52 and a pair of latches 30.

The housing 41 longitudinally forms a plurality of passageways 411 in an upper and a lower sides thereof for receiving the contacts 42 therein. A projecting portion 413 projects from a middle of a front side of the housing 41. Each contact 42 is elongated and comprises a contact portion 423 at a front portion thereof and a straddle tail 421 at a rear portion thereof. A groove 422 is defined in the straddle tail 421.

Figure 4:
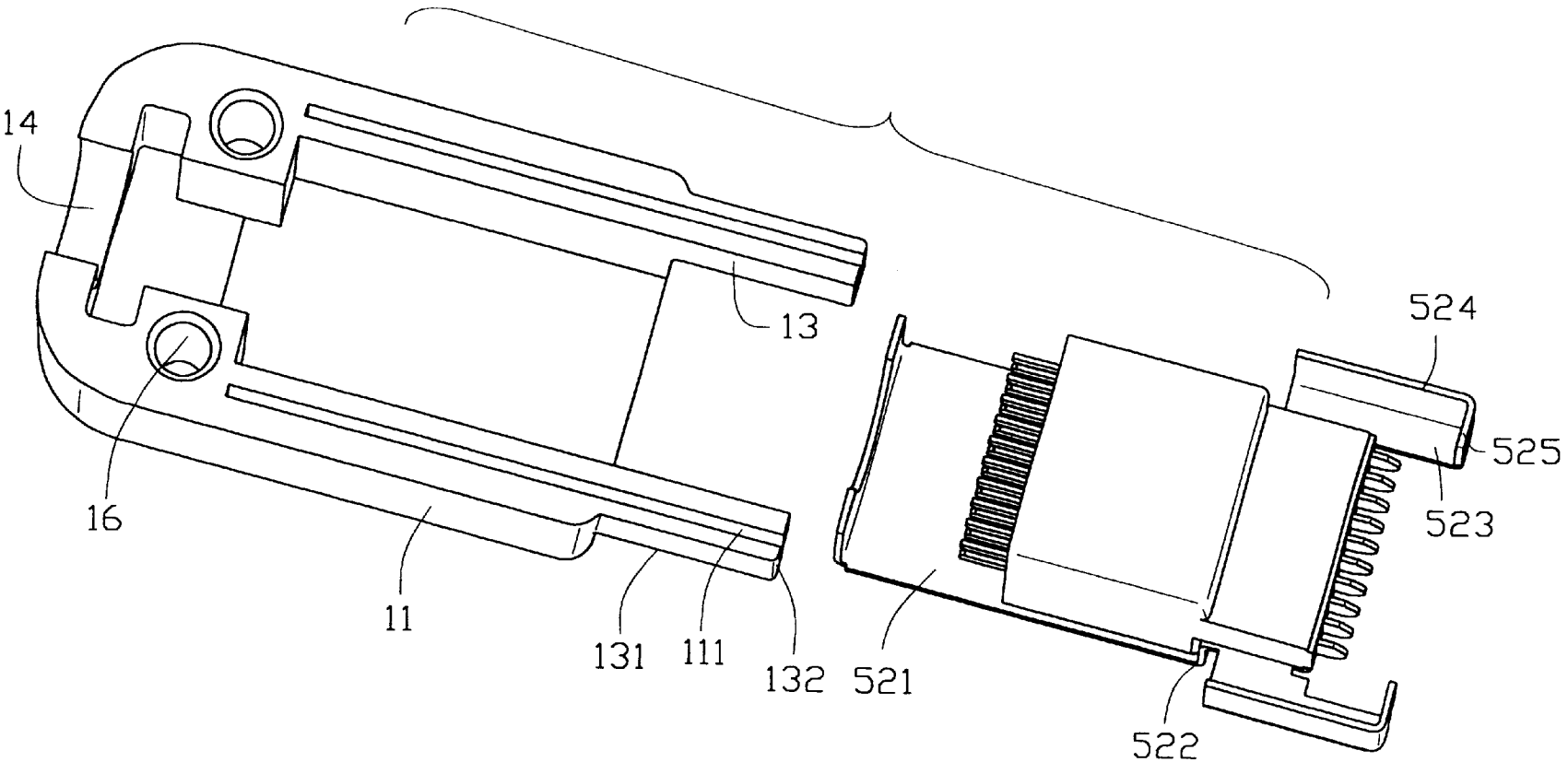
FIG. 4 is a perspective view of the electrical connector showing a base and an assembly of a housing, contacts and shells.
Figure 5:
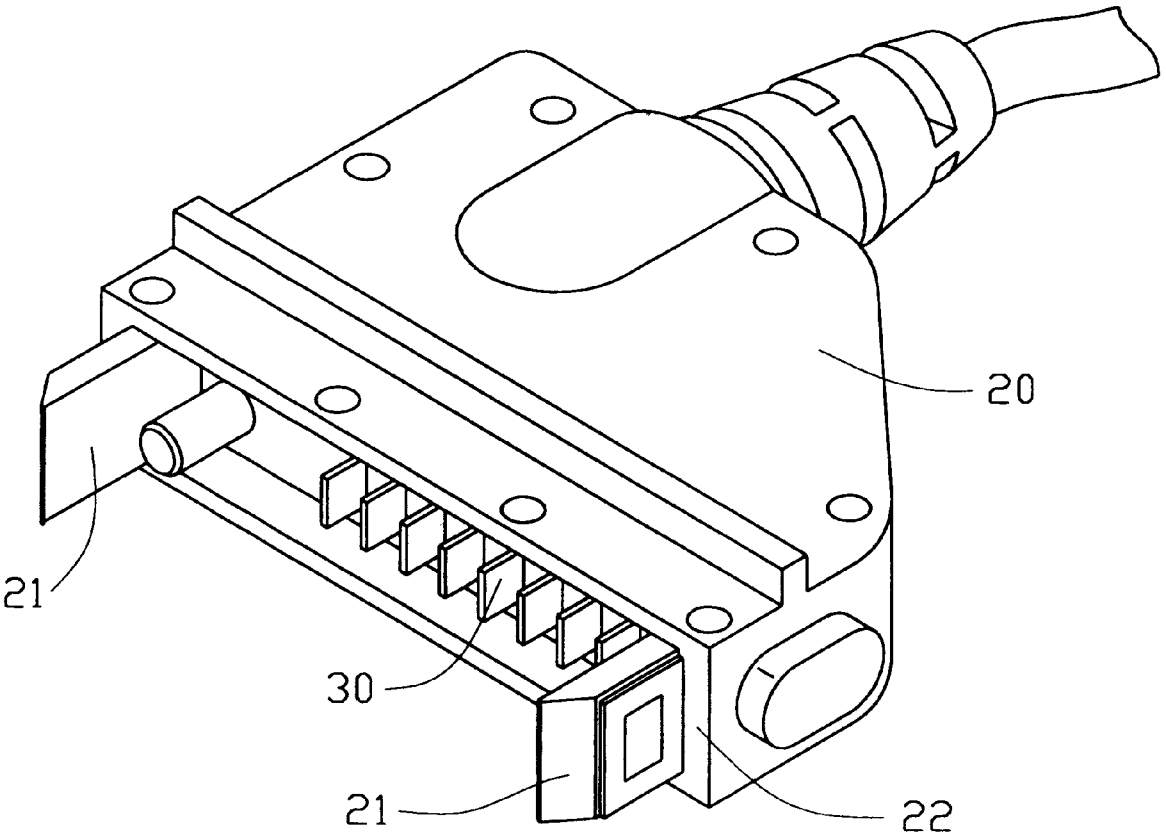
FIG. 5 (PRIOR ART)
FIG. 5 is a perspective view of a conventional electrical connector.

The base 10 is substantially rectangular and includes a pair of lateral walls 11. Referring to FIGS. 1 and 4, the lateral walls 11 define a cavity 12 therebetween at a front portion of the base 10 for accommodating the housing 41. A guiding post 13 is formed projecting forwardly from a front end of each lateral wall 11 for guiding an insertion of a mating electrical connector (not shown) into the electrical connector 1 to have an electrical connection therewith. Each guiding post 13 and associated lateral wall 11 defines a longitudinal slit 111 in a middle thereof for receiving a corresponding latch 30 therein. A printed circuit board 17 is located between the lateral walls 11 of the base 10 for electrically connecting wires of the cable 60 with the contacts 42. A notch 14 is defined in a middle of a rear portion of the base 10 for extension of the end portion of the cable 60 into the housing. A strain relief 15 which is fastened to the end portion of the cable is fitted into the base 10 to prevent a pulling force acting on the cable 60 from adversely affecting the connection between the wires of the cable 60 and the printed circuit board 17. The base 10 further defines a pair of holes 16 in a top face thereof for locking the cover 20 thereto.

Each latch 30 is elongated and includes a locking tongue 32 upwardly extending from a middle thereof, and a triangular retention tab 31 formed on an upper side of a front distal end thereof for engaging with the mating electrical connector.

The upper shell 51 is substantially rectangular and includes a rectangular upper wall 511 having a pair of side walls 512 and an upper flap 515 respectively depending downwardly from opposite side edges and a rear edge thereof. An upper enclosing portion 514 forwardly extends from a front edge of the upper wall 511 for enclosing the projecting portion 413 of the housing 41. The upper flap 515 downwardly defines a semi-circular recess 5151 in a middle of a lower edge thereof.

The lower shell 52 comprises a bottom wall 521, a lower enclosing portion 523 for cooperating with the upper enclosing portion 514, and a transition portion 522 connecting the lower enclosing portion 523 with the bottom wall 521. A lower flap 526 upwardly projects from a rear edge of the bottom wall 521 and upwardly defines a semi-circular recess 5261 in a middle of an upper edge thereof. A pair of side retaining arms 524 respectively depends upwardly from opposite side edges of the lower enclosing portion 523 and engages with outward sides 131 of the guiding posts 13 for strengthening and shielding the guiding posts 13. A front retaining arm 525 inwardly depends from a front edge of each side retaining arm 524 and is substantially perpendicular to the side retaining arm 524. Each front retaining arm 525 engages with a front end 132 of the corresponding guiding post 13 for augmenting the shielding and strengthening effectiveness.

Figure 3:
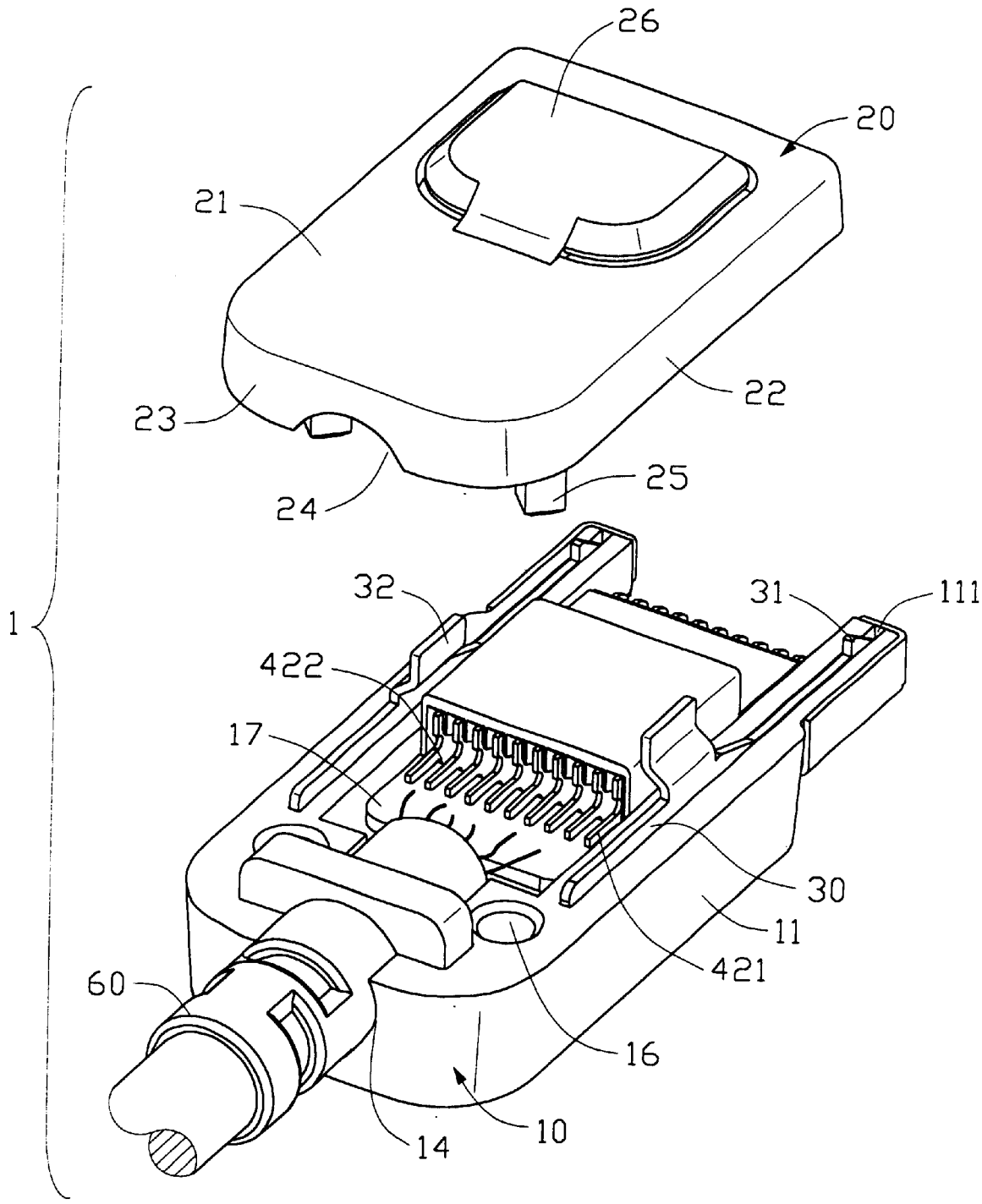
FIG. 3 is a perspective view of the electrical connector from which a cover thereof is removed.

Referring to FIG. 3, the cover 20 comprises a top wall 21. A pair of side flanges 22 and a rear flange 23 depend from opposite side edges and a rear edge of the top wall 21. An operable plate 26 is integrally formed with the top wall 21, the edges thereof being separated from the top wall 21 except for a forward edge thereof. A rearward end of the operable plate 26 rearwardly overlaps the top wall 21. The rear flange 23 defines a top recess 24 in a lower edge of a middle thereof for accommodating the cable 60. The cover 20 further forms a pair of engaging tabs 25 for latching with the holes 16 in the base 10.

Figure 2:
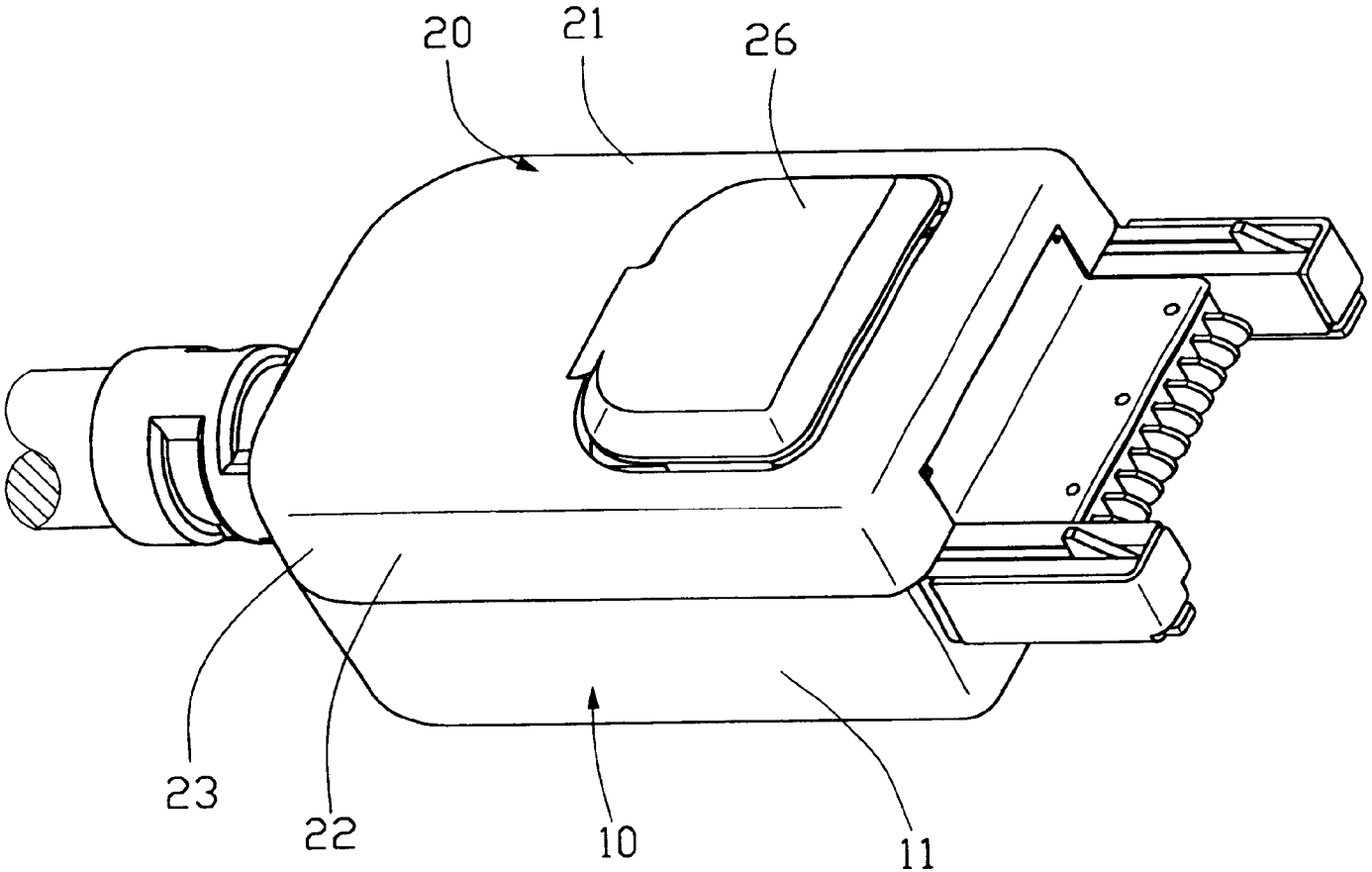
FIG. 2 is an assembled view of FIG. 1.

In assembly, referring to FIGS. 2–4, the contacts 42 are first inserted into the corresponding passageways 411 of the housing 41. The contact portions 423 of the contacts 42 are received in the projecting portion 413 of the housing 41 with a distal end of the contact portions 423 being positioned beyond a front side (not labeled) of the projecting portion 413 (best seen in FIG. 2). The printed circuit board 17 is inserted into the grooves 422, and the contacts 42 are soldered to the printed circuit board 17. The wires of the cable 60 are soldered to the circuit trails of the printed circuit board 17 thereby electrically connecting with the contacts 42. The upper shell 51 and the lower shell 52 are respectively brought to enclose the housing 41 from upper and lower positions. The upper enclosing portion 514 shrouds the projecting portion 413. A lower edge of the upper flap 515 and an upper edge of the lower flap 526 abut each other, and the recesses 5151, 5261 define a circular opening to receive the cable 60. The housing 41, the upper shell 51 and the lower shell 52 are received in the cavity 12 of the base 10. Each latch 30 is interferentially received in a corresponding slit 111. The guiding posts 13 are each received in a space defined by a side retaining arm 524 and a front retaining arm 525. Each front retaining arm 525 abuts the front end 132 of the corresponding guiding post 13, and each side retaining arm 524 abuts the outward side 131 of the corresponding guiding post 13. Therefore, the guiding posts 13 are fully shielded and are effectively strengthened.

The cover 20 is disposed above the upper shell 51 and envelops the housing 41 together with the base 10. The engaging tabs 25 of the cover 20 downwardly plug into the holes 16 of the base 10 to engage the cover 20 with the base 10. The top recess 24 of the cover 20 fits around the cable 60 together with the notch 14 of the base 10. The operable plate 26 abuts the locking tongues 32 of the latches 30 during normal use of the connectors. When the connector 1 is connected to a mating connector, the retention tabs 31 of the latches 30 lock with corresponding elements in the mating electrical connector. When the two connectors are to be disengaged, the operable plate 26 is pressed to downwardly push the locking tongues 32 of the latches 30 and the retention tabs 31 move downward and disengage from the corresponding elements in the mating electrical connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of passageways therein and including a projecting portion forwardly extending from a front thereof;

a plurality of contacts for being received in the passageways of the housing, each contact including a contact portion projecting beyond the projecting portion for engaging with a mating electrical connector;

a base and a cover for enveloping the housing, the base including a pair of lateral walls, a guiding post being formed projecting forwardly from a front end of each lateral wall for guiding the connector to connect with the mating electrical connector; and upper and lower metal shells located in the base and the cover for shielding the housing, the shells including means for strengthening and shielding the guiding post of the base;

wherein the strengthening and shielding means comprises a pair of side retaining arms respectively depending upwardly from opposite side edges of the lower shell, said retaining arms respectively engaging outward sides of the guiding posts;

wherein the strengthening and shielding means comprises a front retaining arm inwardly depending from a front edge of each side retaining arm for engaging a front end of a corresponding guiding post;

wherein the front retaining arms are substantially perpendicular to the side retaining arms;

wherein each guiding post longitudinally defines a slit in a middle thereof;

further comprising a pair of latches received in a corresponding slit;

wherein each latch comprises a locking tongue upwardly extending from a middle thereof and a triangular retention tab at a front distal end thereof for engaging with the mating electrical connector;

wherein the base comprises a cavity defined between the lateral walls of the base for receiving the housing therein;

further comprising a printed circuit board and a cable having wires soldered to the printed circuit board, the printed circuit board transversely being located between the lateral walls of the base, and each contact rearwardly and horizontally forming a straddle tail, a groove being defined in the straddle tail for latching with the printed circuit board, whereby the cable electrically connects with the contacts;

wherein an upper enclosing portion and a lower enclosing portion respectively extend from a front of the upper shell and a front of the lower shell for cooperating with each other to shield the projecting portions of the housing;

wherein the upper shell has an upper flap at a rear thereof and the lower shell has a lower flap at a rear thereof for shielding the housing, and wherein the upper and the lower flaps each define a recess for receiving the cable therein;

wherein the cover further forms a pair of engaging tabs, and the base further defines a pair of holes for latching with the engaging tabs.

* * * * *